United States Patent [19]

Johnson

[11] 4,193,361

[45] Mar. 18, 1980

[54] SEWING MACHINE CONSTRUCTION UTILIZING SUBASSEMBLIES

[75] Inventor: Ralph E. Johnson, Convent Station, N.J.

[73] Assignee: The Singer Company, New York, N.Y.

[21] Appl. No.: 971,962

[22] Filed: Dec. 21, 1978

[51] Int. Cl.[2] ..... D05B 73/00; D05B 73/02

[52] U.S. Cl. ..... 112/259

[58] Field of Search ..... 112/258, 259

[56] References Cited

U.S. PATENT DOCUMENTS

| | | | |
|---|---|---|---|
| 1,005,250 | 10/1911 | Mack . | |
| 1,708,296 | 4/1929 | Greenwood . | |
| 2,497,651 | 2/1950 | Austlid | 112/258 |
| 2,749,862 | 6/1956 | Hale | 112/258 X |
| 3,253,564 | 5/1966 | Gustin | 112/258 |
| 4,044,701 | 8/1977 | Giesselmann et al. | 112/259 |

*Primary Examiner*—Werner H. Schroeder
*Assistant Examiner*—Andrew M. Falik
*Attorney, Agent, or Firm*—William V. Ebs; Edward L. Bell; Robert E. Smith

[57] ABSTRACT

A presser and needle bar head end subassembly and a needle bight control subassembly are mounted in the rear casing section of a zig zag sewing machine on coplanar surfaces which establish a common reference plane for the location of the parts of such subassemblies. The head end subassembly is secured in the machine casing section in an unalterable position, and a feed, loop taker and throat plate subassembly is mounted in the casing to permit lateral adjustment of the throat plate and loop taker relative to a sewing needle.

6 Claims, 2 Drawing Figures

SEWING MACHINE CONSTRUCTION UTILIZING SUBASSEMBLIES

BACKGROUND OF THE INVENTION

1. Field of the Invention

The invention relates to sewing machine constructions and more particularly to the use therein of subassemblies of the operating parts.

2. Description of the Prior Art

It has been the common practice to mount sewing machine subassemblies and individual parts in a casing on machined surfaces of various heights. Since no common reference was provided for the location of the subassemblies and individual parts, accumulated errors in their relative positions occured and operating difficulties were experienced as a consequence. The lack of a fixed unalterable position for a presser and needle bar head end subassembly in the prior machines, and therefor the lack of a precise location for the parts thereof relative to other parts of the machine which physically connected with the subassembly further contributed to the operating difficulties.

SUMMARY OF THE INVENTION

In accordance with the invention, a presser and needle bar head end subassembly and a needle bight control subassembly are mounted on coplanar machined surfaces in the rear section of a zig zag sewing machine casing. The presser and needle bar head end subassembly and the needle bight control subassembly are mounted in unalterable positions in the casing, and a feed control, loop taker and throat plate subassembly is mounted in the casing to permit adjustment of an aperture in the throat plate and of the loop taker relative to a sewing needle as required for trouble free sewing. The presser and needle bar head end subassembly and needle bight control subassembly carry bearings for an arm shaft and may be installed with the arm shaft as a unit in the machine during its manufacture.

DESCRIPTION OF THE PREFERRED EMBODIMENT

Figure 1:
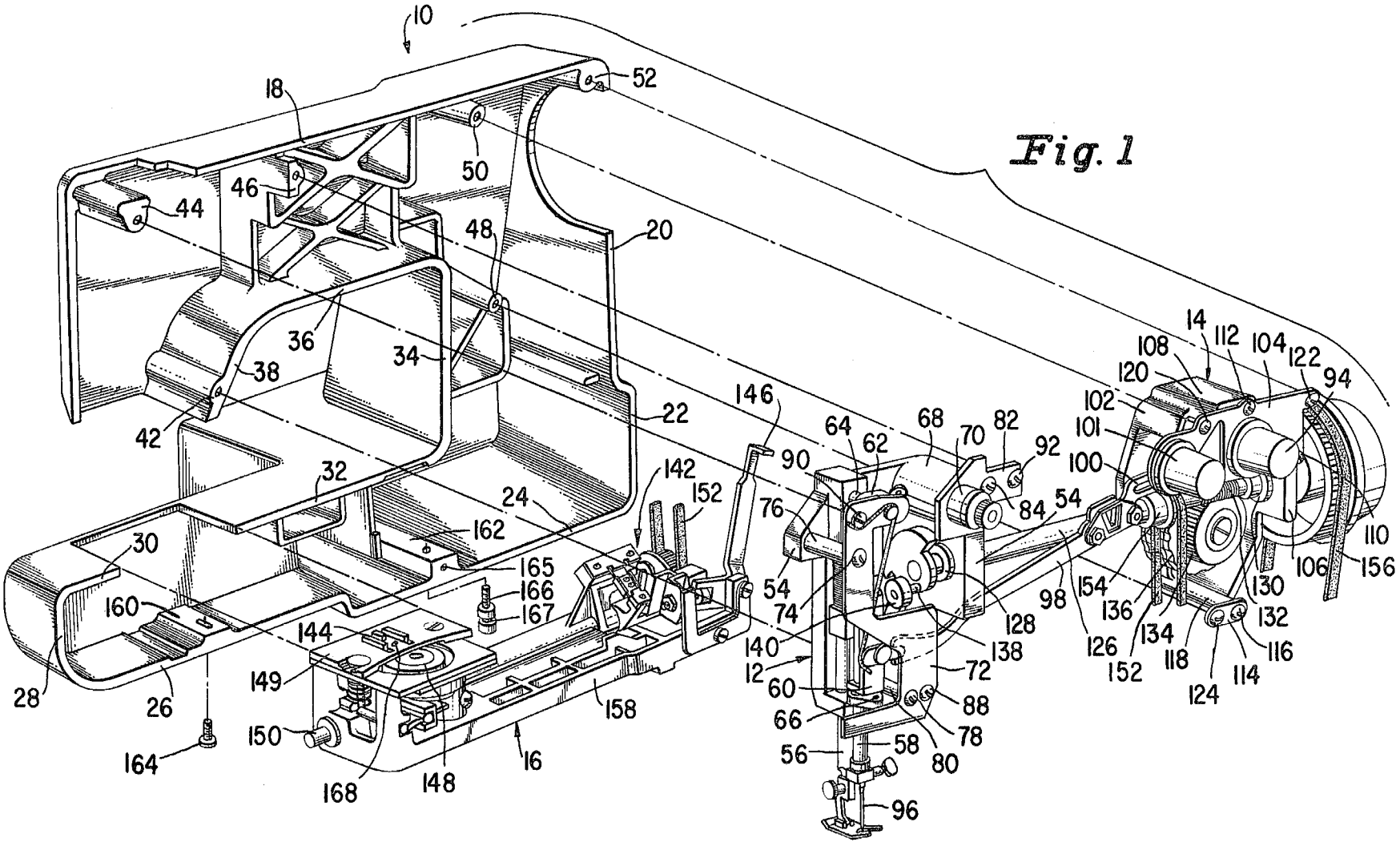
FIG. 1 is an exploded perspective view showing a sewing machine construction according to the invention.
Figure 2:
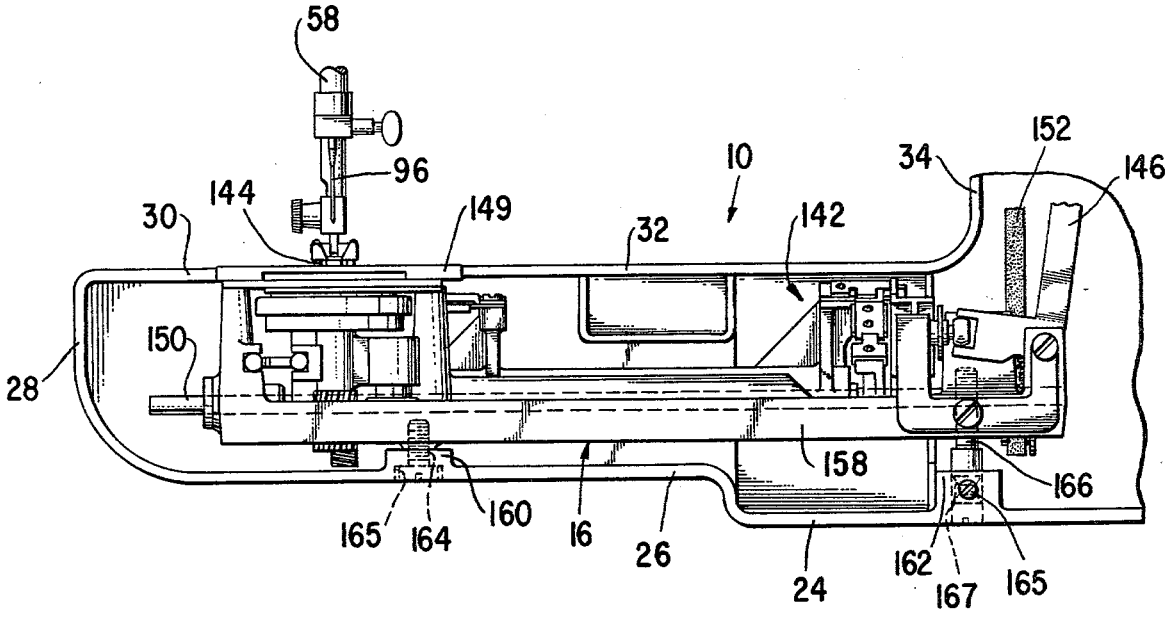
FIG. 2 is a front elevational view showing a feed control, loop taker and throat plate subassembly employed in the construction of the invention.

Reference character 10 designates a cast rear casing section for a sewing machine, and reference characters 12, 14 and 16 designate a presser and needle bar head end subassembly, a needle bight control subassembly, and a feed control, loop taker and throat plate subassembly respectively which mount in casing section 10. The casing is provided with coplanar machined edge portions 18, 20, 22, 24, 26, 28, 30, 32, 34, 36 and 38 which are mounting surfaces for a front cover (not shown) securable to the casing in any suitable manner, as for example with fasteners extending through the cover and casing at points where they do not interfere with mechanism of the machine. In addition the casing is provided with coplanar machined surfaces 42, 44, 46, 48, 50 and 52 which are in the same plane as the aforesaid machined edge portions of the casing and which serve as mounting surfaces for the presser and needle bar head end subassembly and the needle bight control subassembly.

The presser and needle bar head end subassembly 12 includes a rugged frame 54 which carries a presser bar 56 and supports a needle bar 58 for zig zag motion and for up-down reciprocatory motion. Mechanism in the head end subassembly permitting zig zag motion of the needle bar 58 is preferably similar to that disclosed in U.S. patent application Ser. No. 915,084 of The Singer Company filed June 12, 1978, and as shown includes a needle bar bracket 60 which is mounted at its upper end 62 as a pendulum on a shaft 64 affixed in frame 54. Such mechanism further includes a spherical bearing which is located adjacent the lower end of bracket where it is pivoted as a gate in the frame at 66. The needle bar may reciprocate vertically in the needle bar bracket 60 and in a sleeve supported in the spherical bearing as in the construction disclosed in the said U.S. patent application Ser. No. 915,084. The frame 54 includes a boss 68 which supports a rotatably adjustable thread tensioning device 70 of conventional construction.

The presser and needle bar subassembly includes a flat rigid plate 72 which is attached by a screw 74 to the machined end of a post 76 that is an integral part of frame 54, and by a screw 78 to the machined end of a post 80 that is also an integral part of the frame. Another flat rigid plate 82 which is also part of the subassembly is secured by a screw 84 to the machined end of the boss 68 on frame 54. The presser and needle bar head end subassembly 12 including the thread tensioning device 70 is affixed in an unalterable position to the casing section by securing plate 72 to the casing section on mounting surfaces 42 and 44 with screws 88 and 90 respectively, and by securing plate 82 to the casing section on mounting surface 46 with screw 92.

Needle bight control subassembly 14 is preferably of the type shown and described in U.S. patent application of Ralph E. Johnson and John A. Urciola, Ser. No. 971,963 for "Needle Bight Control Mechanism", filed concurrently herewith, and as such is operable to generate cam controlled movements, as selected by the position of a control knob 94, defining a zig zag pattern for movement of a needle 96 affixed in the needle bar 58 which operably connects with the needle bight control assembly through bracket 60 and the links 98 and 100. A control knob 101 is also provided to enable an operator to adjust the amplitude of such zig zag movements. Since the operating mechanism of the needle bight control subassembly 14 may be as disclosed in the said U.S. patent application Ser. No. 971,963 and the speecifics of such mechanism constitute no part of the present invention they are not shown in the accompanying drawings or described herein.

The needle bight control subassembly 14 includes a rugged frame 102 with zig zag controlling mechanism supported therein as described in the said U.S. patent application for "Needle Bight Control Mechanism", a flat rigid plate 104 which is secured to the machined end of a flanged portion 106 of the frame and the machined surface of an integral post 108 of the frame by screws 110 and 112 respectively, and a flat rigid tang 114 which is secured by a screw 116 to the machined end of a post 118 integral with frame 102. Subassembly 14 is affixed in an unalterable position in casing section 10 by securing plate 104 to the casing section on mounting surfaces 50 and 52 with screws 120 and 122 respectively, and by securing tang 114 to the casing section on mounting surface 48 with screw 124.

The presser and needle bar subassembly 12 and the needle bight control subassembly 14 are constructed to support opposite end portions of an arm shaft 126 in bushings 128 and 130 respectively, located in the frame 54 of subassembly 12 and in the frame 102 of subassembly 14. Subassemblies 12 and 14 and the shaft 126 may therefor be preassembled apart from the casing into a unit in which the arm shaft is operably connected through a worm gear 132 and spur gear 134 with a cam stack 136 of the needle bight control subassembly 14, and in which the arm shaft is connected through a stub shaft 138 and drive link 140 with the needle bar of the presser and needle bar head end subassembly. Such unit may then be installed in the casing section 10 on the coplanar mounting surfaces 42, 44, 46, 48, 50 and 52. Since the subassemblies 12 and 14 mount on coplanar machined surfaces in casing section 10, great accuracy in the locations of the subassemblies relative to each other transversely in the casing as required for proper alignment of the interconnecting parts is obtainable.

The feed control, loop taker and throat plate subassembly 16 is of the kind disclosed in U.S. patent application Ser. No. 971,961 of Ralph E. Johnson for "Feed and Loop Taker Module for a Sewing Machine" filed concurrently herewith. Such subassembly includes feed regulating means 142 as described in said application for controlling the travel of a feed dog 144 in accordance with the position of lever 146. The subassembly also includes a vertical axis loop taker 148 and a fixed throat plate 149. The drive for the feed regulating means and loop taker is a bed shaft 150 which is rotatable by a belt 152 engagable with a driving pulley 154 on arm shaft 126. The arm shaft is rotatable by a belt 156 drivable by an electric motor (not shown).

The operating mechanism of the feed control, loop taker and throat plate subassembly is supported in a frame 158 and the frame is mounted in casing section 10 over raised portions 160 and 162 on screws 164 and 166. Screw 166 has a threaded connection with the frame 158 of subassembly 16 and is supported in raised postion 162 of frame 158 on a screw 165 which extends into an annular notch 167 in the screw 166. By turning the screw 166 the subassembly can be raised or lowered to loosen or tighten belt 152. The screws 164 and 166 are located in casing section 10 to define a position for subassembly 16 at least approximately locating the vertical axis of loop taker 148 in the plane of the machined edge portions 18, 20, 22, 24, 26, 28, 30, 32, 34, 36 and 38, and machined mounting surfaces 42, 44, 46, 48, 50 and 52 on casing section 10. Screw 164 is however, located within an enlarged hole 165 in casing section 10 to permit the frame 158 to be pivoted slightly about the other screw 164 for the purpose of effecting fine adjustments in the position of the loop taker 148 and a needle aperture 168 in the throat plate 149 with respect to the needle 96 as required for trouble free sewing after which the screw 164 can be tightened to clamp the frame 158 against raised portion 160 of casing section 10.

It is to be understood that the present disclosure relates to a preferred embodiment of the invention which is for purposes of illustration only, and that various modifications may be made therein without departing from the spirit and scope of the invention as defined in the appended claims.

I claim:

1. In a sewing machine, the combination comprising a sewing machine rear casing section including a plurality of coplanar machined mounting surfaces, a presser and needle bar head end subassembly mounted in an unalterable position in the casing on certain of the said mounting surfaces, a needle bight control subassembly mounted on other of said mounting surfaces, and another subassembly including feed controlling mechanism, a loop taker and fixed throat plate, said another subassembly being adjustably mounted in said casing section to permit the throat plate and needle loop taker to be positioned relative to a sewing needle, and means operably connected with the subassemblies for driving the operable parts thereof.

2. The combination of claim 1 wherein the driving means includes an arm shaft which operably connects the needle bight control subassembly with the presser and needle bar head end subassembly, said head end subassembly and needle bight control subassembly each include an arm shaft bushing, and the arm shaft is rotatably mounted in such bushings.

3. The combination of claim 1 wherein the head end subassembly includes thread tensioning control means.

4. The combination of claim 1 wherein the needle bight control subassembly includes a manually operable control for selecting bight patterns and a manually operable control for selecting bight amplitude.

5. The combination of claim 1 wherein said another subassembly includes a manually operable feed regulating control.

6. The combination of claim 1 wherein the head end subassembly includes thread tensioning control means and the needle bight control subassembly includes bight patterning control means and bight amplitude control means.

* * * * *